US010286986B2

(12) United States Patent
Hugh

(10) Patent No.: US 10,286,986 B2
(45) Date of Patent: May 14, 2019

(54) BOUYANT INFLATABLE DEVICE

(71) Applicant: Christopher Ian Roxburgh Hugh, Redondo Beach, CA (US)

(72) Inventor: Christopher Ian Roxburgh Hugh, Redondo Beach, CA (US)

( * ) Notice: Subject to any disclaimer, the term of this patent is extended or adjusted under 35 U.S.C. 154(b) by 0 days.

(21) Appl. No.: 15/495,955

(22) Filed: Apr. 24, 2017

(65) Prior Publication Data

US 2017/0305514 A1 Oct. 26, 2017

Related U.S. Application Data

(60) Provisional application No. 62/326,003, filed on Apr. 22, 2016.

(51) Int. Cl.
*B63C 9/04* (2006.01)
*B63C 9/00* (2006.01)

(52) U.S. Cl.
CPC ..... *B63C 9/04* (2013.01); *B63C 2009/007* (2013.01); *B63C 2009/0029* (2013.01); *B63C 2009/042* (2013.01); *B63C 2009/044* (2013.01)

(58) Field of Classification Search
CPC ..... B63C 9/04; B63C 2009/042; B63C 2009/0029; B63C 2009/007
USPC ..... 441/80, 35, 40, 41, 43
See application file for complete search history.

(56) References Cited

U.S. PATENT DOCUMENTS 1,203,631 A 11/1916 Kreid
1,410,438 A 3/1922 Willows
2,114,301 A 4/1938 Harrington
2,173,567 A 9/1939 Shafer
2,399,494 A * 4/1946 Manson ..... B63C 9/04 244/905
2,407,666 A 9/1946 Kearny
2,421,679 A 6/1947 Bingham, Jr.
2,914,779 A 12/1955 Walker
2,752,616 A * 7/1956 Coates ..... B63C 9/02 441/40
2,800,666 A 7/1957 Allenbach
2,933,739 A 3/1960 Miller et al.
3,058,127 A 10/1962 Hassold
3,092,854 A 6/1963 Manhart
3,131,406 A 5/1964 Cousteau et al.
3,155,992 A 11/1964 Shewmake et al.
3,176,935 A 4/1965 White et al.
3,574,244 A 3/1971 Huss
3,768,761 A 10/1973 Cramer
3,768,467 A 11/1973 Jennings
3,781,933 A 1/1974 Soter
3,813,717 A 6/1974 Mousetis
3,995,339 A 12/1976 Kaufman
4,187,570 A 2/1980 De Simone
4,342,278 A 8/1982 Horan
4,394,124 A 7/1983 Cooper
(Continued)

*Primary Examiner* — Anthony D Wiest
(74) *Attorney, Agent, or Firm* — Kregg A. Koch

(57) ABSTRACT

A personal flotation device capable of providing buoyancy and preventing hypothermia and death caused by loss of body heat by supporting the individual's entire body out of the water. Special design features increase the ease of use to ensure successful deployment and boarding, even among injured, weak, and/or physically exhausted individuals. This personal flotation device is small and compact, so that it may be used in a prophylactic manner from low-risk to high-risk applications.

20 Claims, 7 Drawing Sheets

(56) References Cited

U.S. PATENT DOCUMENTS

| | | | | | |
|---|---|---|---|---|---|
| 4,731,037 | A | | 3/1988 | Rhodes | |
| 4,747,797 | A | | 5/1988 | Hindle | |
| 4,750,447 | A | | 6/1988 | Spinosa et al. | |
| 4,907,997 | A | | 3/1990 | Hall | |
| 4,942,839 | A | * | 7/1990 | Chuan | B63B 7/08 114/125 |
| 5,170,738 | A | | 12/1992 | Patten | |
| 5,219,307 | A | * | 6/1993 | Morrison | B63B 35/76 114/264 |
| 5,284,453 | A | | 2/1994 | Kun | |
| 5,297,978 | A | * | 3/1994 | Ramsey | B63B 7/08 114/345 |
| 5,421,757 | A | | 6/1995 | Basiliere | |
| 5,437,569 | A | | 8/1995 | Ming | |
| 5,738,557 | A | | 4/1998 | Biesecker | |
| 5,888,111 | A | | 3/1999 | Walker | |
| 5,987,661 | A | * | 11/1999 | Peterson | E04H 4/10 4/488 |
| 6,164,237 | A | | 12/2000 | Coryell et al. | |
| 6,574,804 | B1 | | 6/2003 | Boujon | |
| 7,335,078 | B2 | | 2/2008 | Kent | |
| 7,666,046 | B2 | | 2/2010 | Larochelle | |
| 7,704,112 | B2 | | 3/2010 | Kim | |
| 7,896,719 | B2 | | 3/2011 | Rayes et al. | |
| 7,918,698 | B2 | | 4/2011 | Schloegel | |
| 8,070,543 | B1 | | 12/2011 | Faletra | |
| 8,414,340 | B1 | | 3/2013 | Vu | |
| 8,668,539 | B2 | | 3/2014 | Chun et al. | |
| 8,920,205 | B2 | | 12/2014 | McCarthy | |
| 2013/0203310 | A1 | | 8/2013 | Newman | |
| 2014/0256199 | A1 | | 9/2014 | Tatum | |

* cited by examiner

BOUYANT INFLATABLE DEVICE

CROSS-REFERENCE TO THE PRESENT DISCLOSURE

This United States Non-Provisional patent application claims the priority of U.S. Provisional Application No. 62/326,003, titled: "BUOYANT ANTI-HYPOTHERMIA APPARATUS," filed Apr. 22, 2016 in the United States Patent and Trademark Office, the disclosure of which is hereby incorporated by reference in its entirety.

FIELD OF THE PRESENT DISCLOSURE

This disclosure relates generally to personal protective equipment and more specifically to a lightweight and compact personal flotation device that is capable of both providing buoyancy and reducing loss of personal thermal energy.

BACKGROUND OF THE RELATED ART

Anytime a vehicle, whether it be a ship or an aircraft, travels over a large body of water, there exists a risk that due to an unfortunate occurrence, such as human error, adverse weather, or mechanical failure, passengers and/or crew may find themselves in the water attempting to survive without the vehicle. This may occur far from shore and last for extended periods of time. In such emergency situations, survival depends, in large part, on an individual's ability to stay at the surface of the water to facilitate breathing until assistance can arrive.

Many times, assistance may take several hours or even days to arrive, which may exceed the length of time the individuals in need of rescue are capable of treading water or otherwise physically remaining at the surface under their own power. This is further compounded by the fact that, in many such situations, passengers and/or crew may have sustained injuries during the occurrence that separated them from their vehicle, which may significantly reduce their stamina and/or ability to exert physical effort to remain on the surface of the water. To address this unfortunate contingency, most vehicles that travel over large bodies of water carry personal flotation devices for each individual aboard the vehicle.

The most common form of the personal flotation device is the life vest. A life vest is a positively buoyant device that fits an individual like a vest when properly worn and increases the individual's overall buoyancy such that, at a minimum, the individual's head remains above water without requiring physical effort. In many situations, a properly worn life vest can greatly increase the amount of time an individual can survive while waiting for assistance to arrive.

However, there are some significant drawbacks to life vests. For example, many life vests are constructed from highly buoyant material. Because buoyancy is a function of density, such highly buoyant material is typically very voluminous, making wearing such life vests highly awkward and cumbersome. This, in turn, causes many individuals to forgo wearing a life vest until an emergency situation arises or is immediately foreseeable. This behavior reduces the effectiveness of the life vest because it causes a risk that the individual in need will not be able to locate or properly don the device in time, if an emergency situation materializes rapidly.

This shortcoming has been addressed, in part, by the inflatable life vest. While still inconvenient to wear regularly, inflatable life vests are considerably less awkward and cumbersome to wear, because their buoyancy is derived from an air impermeable bladder that is capable of being inflated when activated, either automatically or manually, but that otherwise remains in a deflated, low-profile position. Because inflatable life vests are considerably less awkward and cumbersome to wear, individuals are much more likely to wear them prophylactically, and therefore, individuals are much more likely to already be properly wearing them when an emergency situation unexpectedly materializes. It is important to note that, generally, when personal protective equipment is not awkward and/or cumbersome, use rates of such equipment tend to rise, and therefore, such equipment is typically more effective at saving lives in practice.

There are additional survival challenges associated with water emergencies that life vests cannot effectively address. Perhaps the most significant challenge is that many of the bodies of water that vehicles regularly cross are of a temperature such that individuals in direct contact with the water would not survive for very long, even if they could manage to keep their heads above water indefinitely. When properly wearing a life vest in the water, an individual's body is almost entirely submerged and in direct contact with the water. Water is very proficient at transferring heat away from an individual's body at a fairly rapid rate. Therefore, prolonged submersion in even mildly cold water can be lethal within a deceptively short period of time.

For example, an average person is only expected to stay conscious for 1-2 hours in water that is between 50 and 60 degrees Fahrenheit. In many water emergency situations, 1-2 hours is far shorter than the amount of time that is required for assistance to arrive, even if the assisting party is aware of the exact location of the individual or individuals in need. In situations where the individual or individuals in need must be located first, rescue times can be considerably longer.

Further, large portions of the earth's ocean are much colder than 50-60 degrees Fahrenheit. This means that if a water related emergency situation arose in those regions, a life vest alone would have little or no ability to increase survivability. There exists a need for an emergency flotation aid that is capable of thermally insulating an individual as well as providing buoyancy.

There have been several attempts to mitigate this thermal limitation to traditional life vests by incorporating some form of thermal insulation. Two examples of such attempted solutions are the float coat and the more extreme survival suit.

A float coat is essentially a thermally insulated jacket that includes an inflatable life vest incorporated within. While a float coat may provide more thermal insulation than the typical life vest, most float coats are primarily designed to thermally insulate an individual from thermal loss caused by air, and therefore, are not designed to be particularly proficient at insulating individuals when submerged in water.

By contrast, survival suits are designed to thermally insulate an individual in water and are very effective at achieving this goal; however, survival suits are also very expensive, bulky, require considerable time get into, and because of their waterproof nature, typically do not breathe adequately to be worn comfortably, making them an unsatisfactory option for prophylactic, low-risk use. There exists a need for a personal flotation device that can provide buoyancy and thermal insulation without causing excessive personal inconvenience while performing low risk activities.

Another legacy solution to this water safety problem is the life raft. A life raft typically provides flotation for several individuals and provides the added benefit of allowing individuals to climb out of the water, thereby significantly reducing the rate of thermal loss due to water. Life rafts do, however, have their limitations as well. The biggest limitation is their typical size. Most life rafts are too large and bulky to be physically attached to or worn by an individual; therefore, while most vehicles that travel across large bodies of water carry a life raft, in order to realize the safety benefits of a life raft, an individual on an ill-fated vehicle must have the opportunity to locate where the life raft is stored, remove the life raft, and deploy the life raft. Depending on the circumstances of the water emergency, this opportunity may not always be available.

The typical inflatable life raft is designed to accommodate approximately 4 people, while larger models used on passenger ships and ferries may hold up to 50 people. Most private vessels, small planes and helicopters venturing offshore carry a life raft with a capacity equal to or greater than the number of crew onboard. A typical life raft on these crafts are in the 4-8 person capacity range. These life rafts are quite heavy, weighing 50-100 lbs and are quite bulky, which makes them difficult to remove from their stored position and similarly difficult to deploy. In a man overboard situation, a rapidly sinking vessel, or the downing of an aircraft over water, there often isn't enough time for victims to wrestle a large, heavy, inflatable life raft out of its stored position and deploy it. This difficulty may leave individuals in direct contact with the water for an extended period of time and prone to hypothermia and/or death.

Most smaller boats and skiffs do not carry life rafts because they are too bulky and too heavy to have onboard. Moreover, one study recorded 28% of fatalities from commercial fishing vessel loss in California, Oregon and Washington between 2000 and 2006 had no raft aboard.

Some pilots carry one man inflatable life rafts in their aircraft, or strap them to their waist. These rafts typically weigh approximately 6-8 lbs. and have an approximate size of 7" diameter by 12" long. Their weight and bulkiness make the wearer less agile, particularly when climbing through the small door of a sinking plane or while having to maneuver underwater. Fear of not being able to egress the vehicle in a water emergency or simply preferring to not endure the inconvenience of the safety equipment during normal, low risk operation of the vehicle causes many pilots, aircrew and mariners to forego use of these life rafts.

Other issues with these one man life rafts include their high cost and the difficulty of boarding them once deployed. Climbing over the edge of a legacy life raft can be difficult, especially for those who may have been injured in the incident that caused the water emergency. If an individual deploys a legacy life raft and cannot climb in, they may perish from hypothermia as if they did not have a life raft.

These adverse factors (bulk, weight, cost and boarding difficulty) make legacy life rafts a less than ideal solution for many people including air crewmen, deck personnel on ships of all sizes, sailors, commercial and recreational fishermen and other mariners whose lives could potentially be saved if there existed a lightweight personal water safety device that provided both buoyancy, ease of ingress, and thermal protection. There exists a need for a life raft that is small, lightweight, less expensive and easier to board than the currently available models.

The present disclosure distinguishes over the related art, providing heretofore unknown advantages as described in the following summary.

BRIEF SUMMARY OF THE DISCLOSURE

The present disclosure describes an improved buoyant water safety apparatus that is pocket-sized in its packed, deflated state, lightweight, and easy to board once deployed.

When in a deflated state, the apparatus of the present disclosure is stored in a pocket-sized enclosure that is supplied with a securing clip and/or a lanyard, which connects the apparatus to a user. Pocket-sized being defined as less than three (3) pounds and approximately 1.5"×4"×5", by way of example, so that it is physically small enough to not impede the egress of the passengers and/or crew when egressing the ill-fated vehicle. A preferred embodiment would be no larger than seventy-two (72) cubic inches when deflated, some embodiments of the apparatus may even be smaller, especially when designed for smaller people. Larger embodiments may exceed the above mentioned dimensions, but should use the same technology to be smaller and lighter than the legacy solutions. Preferred materials would be thinner than eight (8) mils in thickness and with a tensile strength of at least twenty-three (23) pounds per square inch.

In some embodiments, the presently disclosed apparatus may be secured to the individual by a belt or a strap. In other embodiments, the apparatus may be incorporated into the pocket of an individual's clothing or uniform. The main advantage being that the presently disclosed apparatus is small enough when in the pre-deployment orientation that it may be attached to an individual while performing low risk activities without interfering with the individual's duties or comfort.

This is a significant advantage over legacy solutions because safety gear that can be worn routinely while performing low-risk duties is far more likely to be present and available during unforeseen emergency situations. In addition, the present invention completely supports a user out of the water, dramatically increasing survival chances, particularly in cold water. A preferred embodiment would be able to support at least an 80 lbs. person completely out of the water.

In an emergency situation, such as a vessel sinking, aircraft downing over water or a man-overboard situation, a user can quickly inflate and deploy the buoyant apparatus. This is accomplished by actuating a compressed gas cylinder or conventional nitrogen generator via a pull cord. Other inflation mechanisms are possible, so long as the inflation mechanism is compact, stable, and capable of releasing or creating the proper quantity of gas to inflate the apparatus within a short period of time upon activation. In some embodiments, the apparatus may be inflated by foam or a substance expanding to a low density. Many embodiments also include valves for oral inflation. These maybe used as a back-up method or in extra-compact embodiments as a primary method.

Once inflation is initiated, the apparatus quickly becomes buoyant, providing the distressed individual with assistance staying at the surface of the water without exerting energy and provides the individual the ability to fully exit the water so that the individual's body is not in direct contact with the water while waiting for assistance. Due to the inflatable floor, the presently disclosed apparatus is able to put at least one inch of air between the water and the occupant, acting as a thermal insulator. This is beneficial to its function of expanding the survival time of individuals waiting for rescue in cooler waters and is a major improvement over legacy life vests because full exposure to even mildly cold water can quickly cause hypothermia or death. Embodiments for use in warm water areas do not require the inclusion of an inflatable floor.

When inflated, the present disclosure comprises an inflatable floor which is circumscribed, enclosed, and attached to an air bladder (or series of bladders) forming a wall or gunwale. In most embodiments, the shape of the air bladder is slightly elliptical and designed to accommodate a singular human. However, an air bladder can take on any shape defined by the enclosing air bladder's perimeter. The inflatable floor is attached to the lower inner circumference of the air bladder, creating a buoyant, thermally insulated cavity in which an individual can occupy.

The inflatable floor includes a ingress orifice to facilitate easy boarding, defined by a semi-detachable flap that can be affixed in the open or closed orientation by manipulating the flap. The ingress orifice allows an individual to enter the apparatus through the floor rather than climbing over the air bladder. This is beneficial, because climbing over an air bladder and into an apparatus requires significant strength and effort that an individual might not have if he or she is fatigued, injured, wearing bulky gear, such as a legacy life vest, or is simply not strong enough. Failing to enter the apparatus could prove fatal depending on the temperature of the water.

The semi-detachable flap can be easily opened, allowing for entry into the apparatus from underneath, and may be securely reattached, thereby resuming its function as a further portion of the structurally secured and thermally insulated floor. A wide variety of reversible securing mechanisms can be utilized to facilitate the semi-detachable flap's capability. A preferred embodiment features a high strength plastic zipper; however, other mechanisms are acceptable as well, such as, hook and loop systems, snaps, or buttons.

In a preferred embodiment, the semi-detachable flap is approximately 15 to 24 inches wide, allowing the user to easily board the raft by lifting himself out of the water, with one hand on each tube, once he has entered the orifice. The apparatus is designed so that an individual entering the apparatus through the ingress orifice can climb on the inflatable floor, which should be located just above the water level, thereby requiring minimal effort. This is an important feature, because a sufficiently wide ingress orifice allows and individual to position himself square to the inflatable floor while boarding, thereby distributing his or her weight equally and reducing the possibility that the apparatus will tip or roll during boarding. In a preferred embodiment, the orifice should between 20 to 36 inches in the opposing direction (length) so that an individual can climb through the ingress orifice created, by opening the semi-detachable flap with ease, especially when wearing other safety gear such as a legacy life vest.

To board the apparatus, an individual can either dive under the inflated apparatus and emerge with their body through the ingress orifice, or to enter the apparatus without putting their head below water, such as when the individual is wearing a life vest, the individual can lift the apparatus off the water by pressing upward on one end of the air bladder and lower the apparatus over his or her head. Some embodiments include an air bladder segment located adjacent the ingress orifice, thereby increasing the ease with which the apparatus can be lifted, by increasing flexibility of the air bladder at the segment. In such embodiments, an individual can lift one end of the air bladder while the other end stays level with the water because of the added flexibility of the air bladder segment. An advantage of such a lightweight apparatus is that it may be easily lifted or manipulated in order to facilitate boarding.

Once an individual is positioned with his or her body through the ingress orifice, the individual can fully board the apparatus by pressing down on each side of the air bladder or simply crawling onto the inflated floor. Some embodiments include various loops, handles, or gripping points to assist boarding. After an individual is fully boarded, the semi-detachable flap may be closed and reattached, thereby preventing water from splashing into the apparatus and creating more floor space.

In another embodiment of the present disclosure, the air bladder does not continuously circumscribe the inflatable floor and there is no ingress orifice. Instead, the air bladder has a break, formed by distal ends of the air bladder that tightly abut one another and the inflatable floor features a semi-detachable slit. When the semi-detachable slit is in the attached orientation, the distal ends of the air bladder tightly abut each other, acting as a continuous gunwale; however, when the semi-detachable slit is in the open orientation, the distal ends of the air bladder can be horizontally separated by an individual, creating space to ingress the apparatus between the distal ends of the air bladder.

Once the individual is securely aboard, the semi-detachable slit in the inflatable floor can be returned to the attached orientation and the distal ends of the air bladder will orient securely abut each other, again creating a continuous gunwale. The semi-detachable slit utilizes a reversible attachment system. A preferred embodiment would feature a high strength plastic zipper, but other reversible fasteners will work as well, such as a sliding fastener, hook and loop systems, or buttons.

This disclosure teaches certain benefits in construction and use which give rise to the objectives described below.

A primary objective inherent in the above described method and apparatus is to provide advantages not taught by the prior art.

Another objective is to provide an innovative buoyant apparatus designed to be lightweight and low profile, so that it can be worn or carried, while performing routine low risk behaviors, without causing excessive interference or discomfort.

A further objective is to provide an effective water emergency safety apparatus that is capable of providing buoyancy and thermally insulating an individual from the water temperature, thereby reducing the risk of hypothermia or death while awaiting rescue.

A still further objective is to provide a water emergency safety apparatus that is easy to board when fatigued, injured, or wearing other safety equipment, thereby increasing the chance that a distressed individual can properly utilize the apparatus and survive a water related emergency.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

The accompanying drawings illustrate various exemplary implementations and are part of the specification. The illustrated implementations are proffered for purposes of example, not for purposes of limitation. Illustrated elements will be designated by numbers. Once designated, an element will be identified by the identical number throughout. Illustrated in the accompanying drawing(s) is at least one of the best mode embodiments of the present disclosure. In such drawing(s):

FIG. 8 illustrates the apparatus bending at the air bladder segments.

Figure 1:
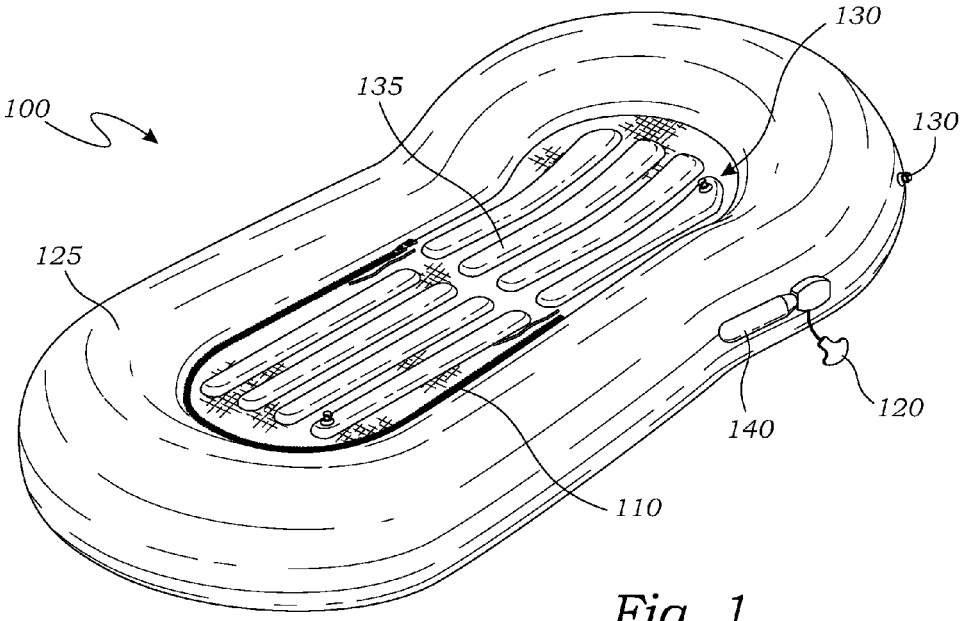
FIG. 1 is a perspective view of an exemplary embodiment of the presently described apparatus, illustrated featuring a semi-detachable flap covering an ingress orifice, the semi-detachable flap illustrated in the closed orientation.
Figure 11:
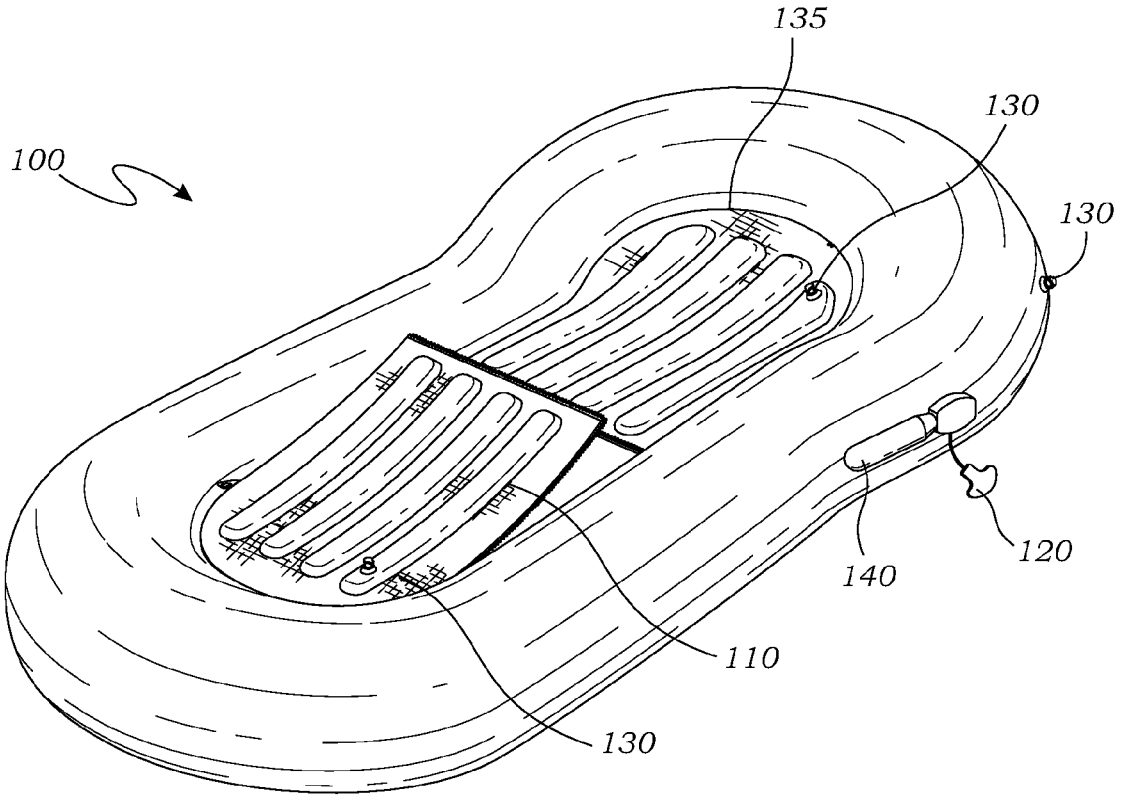
Figure 12:
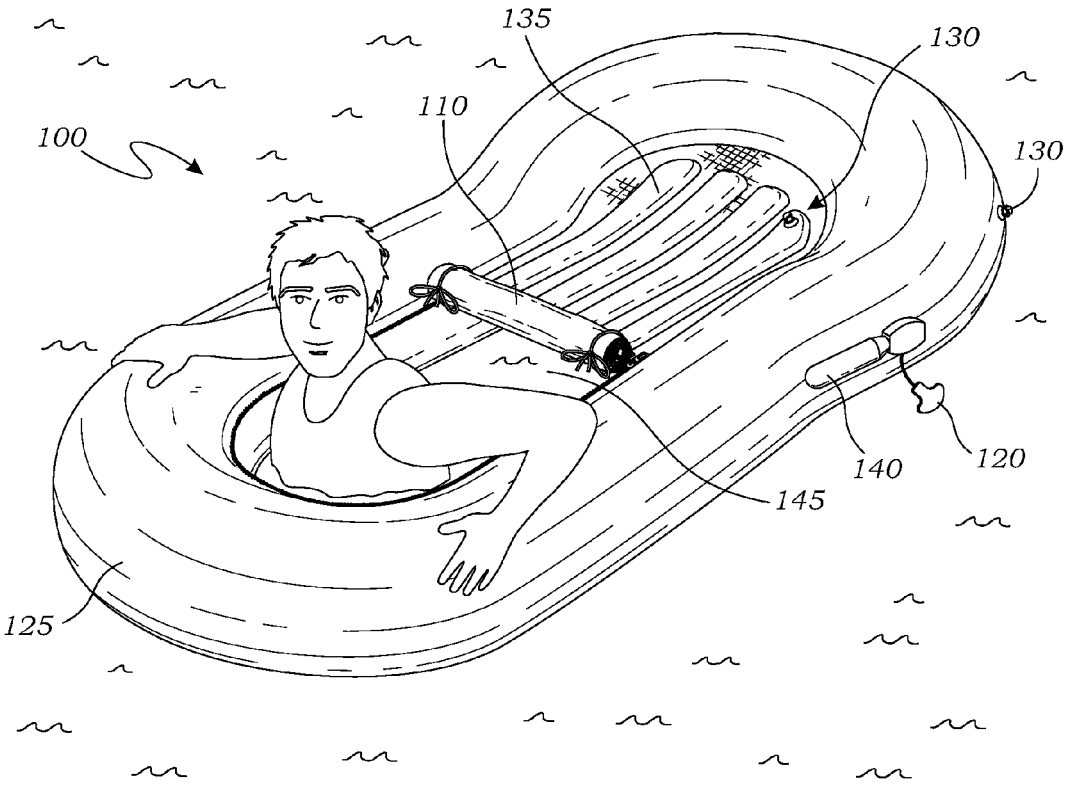

FIG. 11 is a perspective view of an exemplary embodiment of the presently described apparatus, illustrated featuring a semi-detachable flap covering an ingress orifice; the semi-detachable flap illustrated in FIG. 11 is located in a different position than it is in FIG. 1. This is included to demonstrate that the ingress orifice and semi-detachable flap may be oriented differently in different embodiments;

FIG. 12 is a perspective view of an exemplary embodiment of the presently described apparatus, featuring a semi-detachable flap covering an ingress orifice, the semi-detachable flap is illustrated in the open and rolled orientation with an exemplar individual boarding the apparatus included for scale.

DETAILED DESCRIPTION OF THE EXEMPLARY EMBODIMENT

The above described drawing figures illustrate an exemplary embodiment of the joint apparatus and its method of use in at least one of its preferred, best mode embodiments, which is further defined in detail in the following description. Those having ordinary skill in the art may be able to make alterations and modifications to what is described herein, without departing from its spirit and scope of the disclosure. Therefore, it must be understood that what is illustrated is set forth only for the purposes of example and that it should not be taken as a limitation in the scope of the present apparatus and method of use.

Described now in detail is a lightweight and compact personal flotation device that is capable of both providing buoyancy and reducing loss of personal thermal energy.

FIG. 1 depicts the presently disclosed apparatus 100 in a fully deployed orientation featuring a semi-detachable flap 110 in the attached orientation covering the ingress orifice 145. The apparatus is automatically inflated when an individual pulls a pull cord 120. The illustrated embodiment shows a compressed gas cartridge 140 as the source of the inflation gas. Other embodiments can use other sources of inflation gas.

FIG. 1 also shows a plurality of self-inflation valves 130. These valves can be used to restore inflation if the apparatus slowly becomes deflated because of damage. In some embodiments self-inflation may be the primary mode of inflation for the inflatable floor 135, with automatic inflation only being available for the primary air bladder 125.

Figure 2:
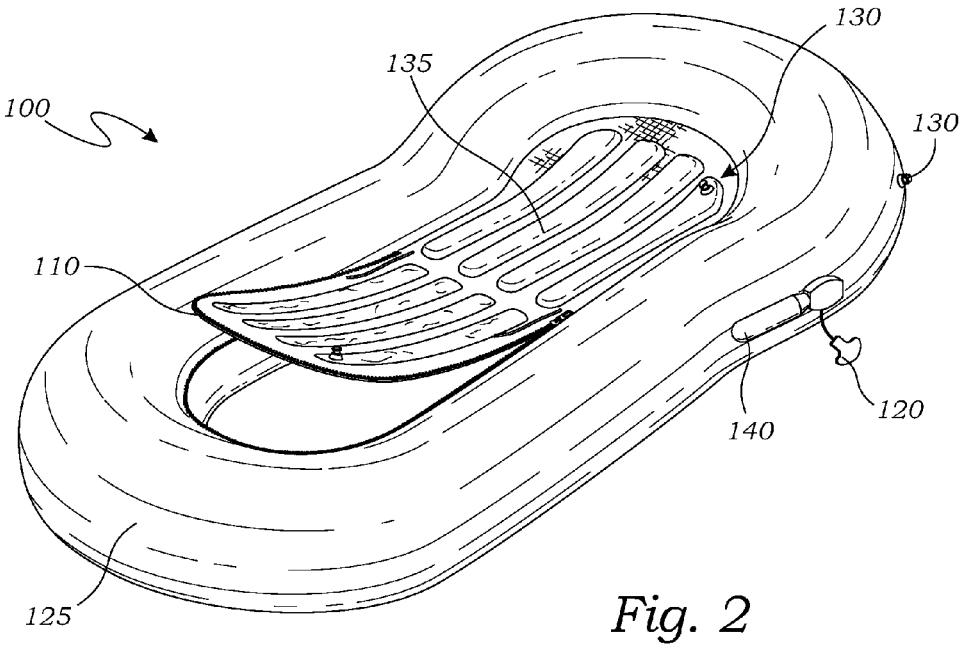
FIG. 2 is a perspective view of an exemplary embodiment of the presently described apparatus illustrated featuring a semi-detachable flap covering an ingress orifice, the semi-detachable flap illustrated in the open orientation.

FIG. 2 shows the semi-detachable flap 110 in the detached orientation thereby starting to expose the ingress orifice 145. Once the semi-detachable flap 110 is in the open orientation, an individual can board the apparatus through the ingress orifice 145. It is important that the ingress orifice 145 is wide enough that the individual can board with his back square to the remaining portion of inflatable flooring 135 because this is the most stable way to board the apparatus 100.

Figure 3:
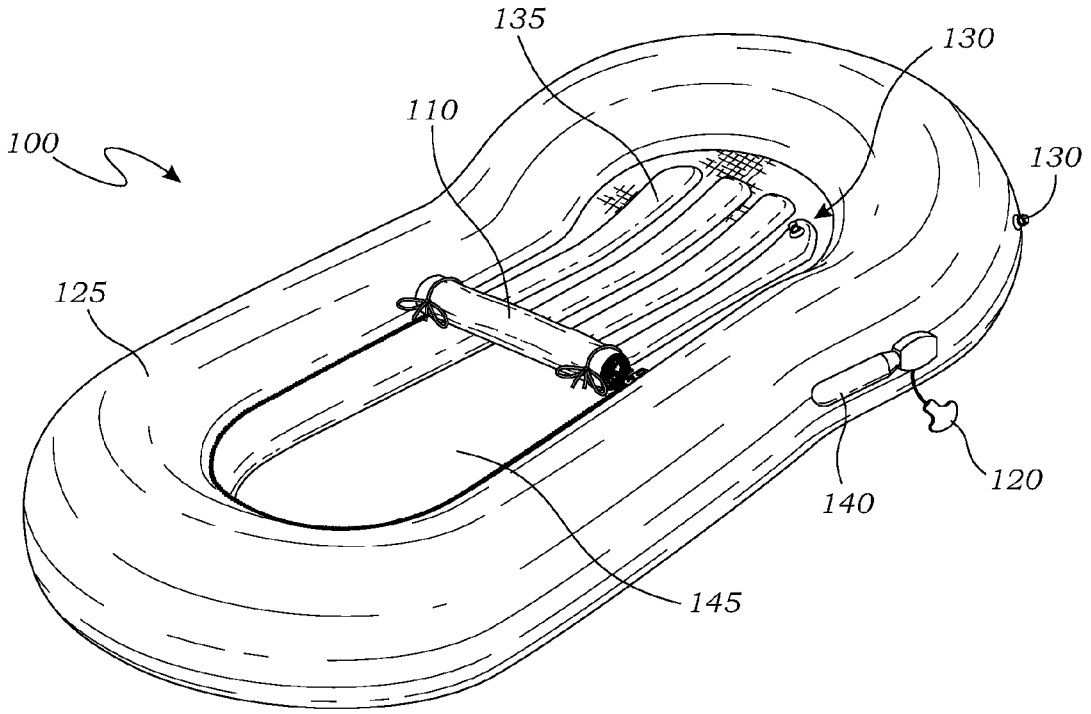
FIG. 3 is a perspective view of an exemplary embodiment of the presently described apparatus illustrated featuring a semi-detachable flap covering an ingress orifice, the semi-detachable flap illustrated in the open and rolled orientation.

FIG. 3 shows the semi-detachable flap 110 in the fully open, rolled, and tethered orientation. Some embodiments allow for the semi-detachable flap 110 to be rolled and tethered so that it is fully out of the individual's way when boarding. In some embodiments, the semi-detachable flap 110 may need to be manually inflated after the semi-detachable flap 110 is unrolled and reattached.

Figure 4:
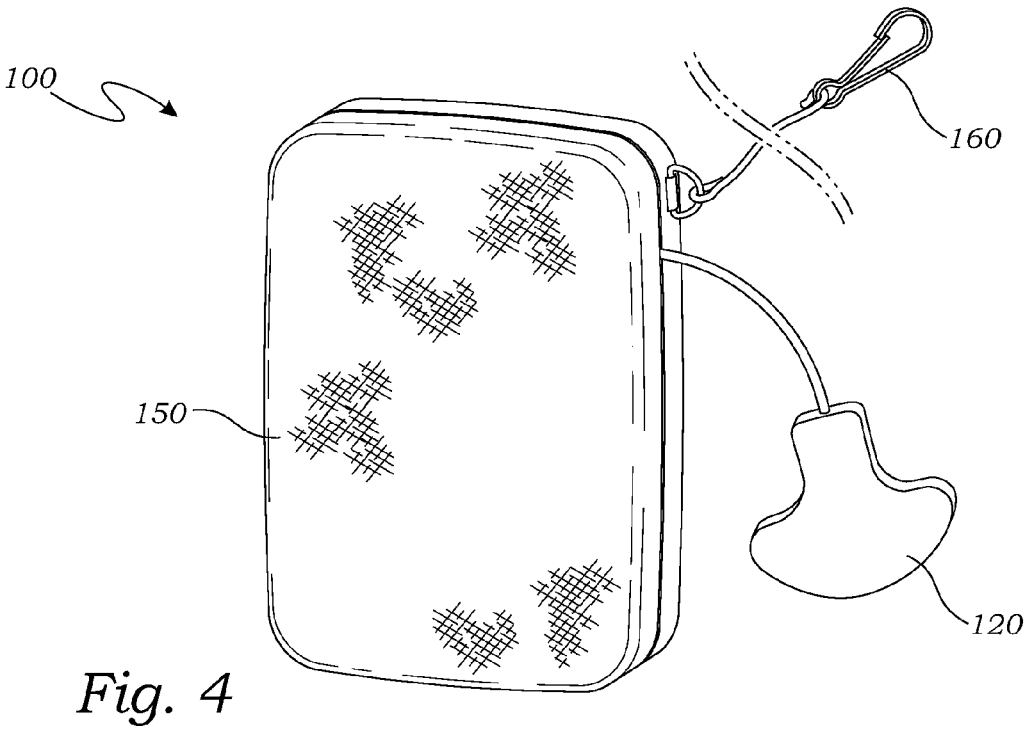
FIG. 4 is a perspective view of an exemplary embodiment of the presently described apparatus illustrated in the pre-deployment orientation.

FIG. 4 illustrates and exemplary embodiment of the presently disclosed apparatus 100 in the pre-deployed state. The illustrated embodiment illustrates a small, lightweight, case 150 featuring only a pull cord 120 to activate inflation and a tether 160 to attach the apparatus 100 to an individual performing routine low risk activities near water. In some embodiments the tether 160 is attached to the apparatus 100 rather than the case 150 so that when an individual activates the inflation the apparatus 100 cannot drift or blow away.

Figure 5:
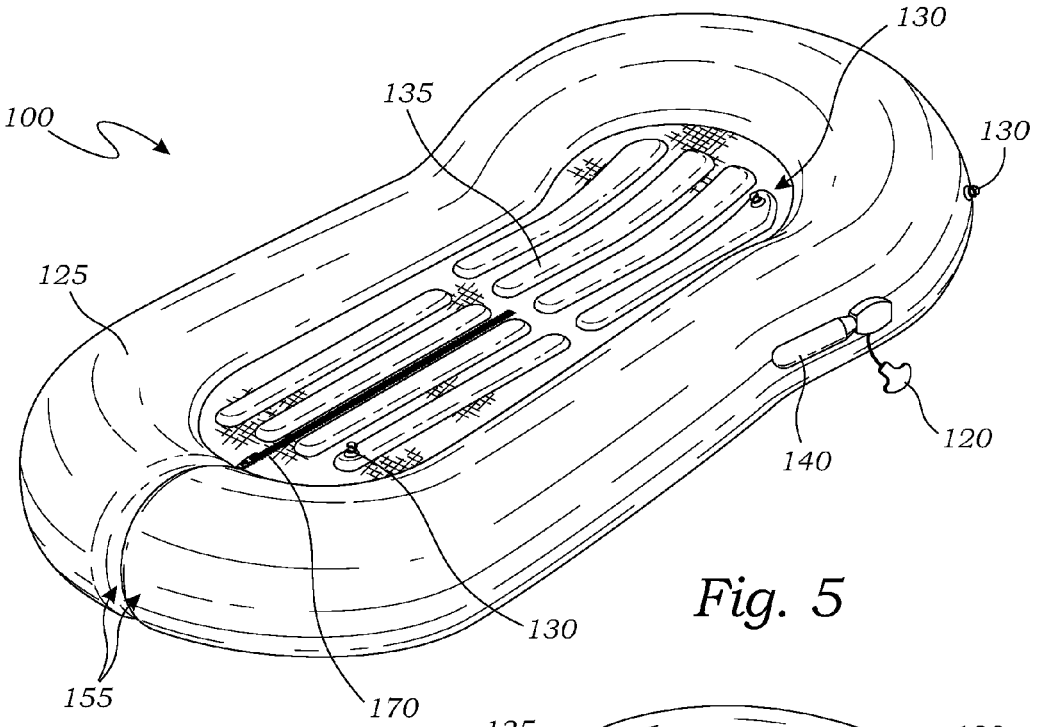
FIG. 5 is a perspective view of an exemplary embodiment featuring a semi-detachable slit in the inflatable floor and a gunwale break at one end of the apparatus formed by two terminal ends of the air bladder which firmly abut each other.
Figure 6:
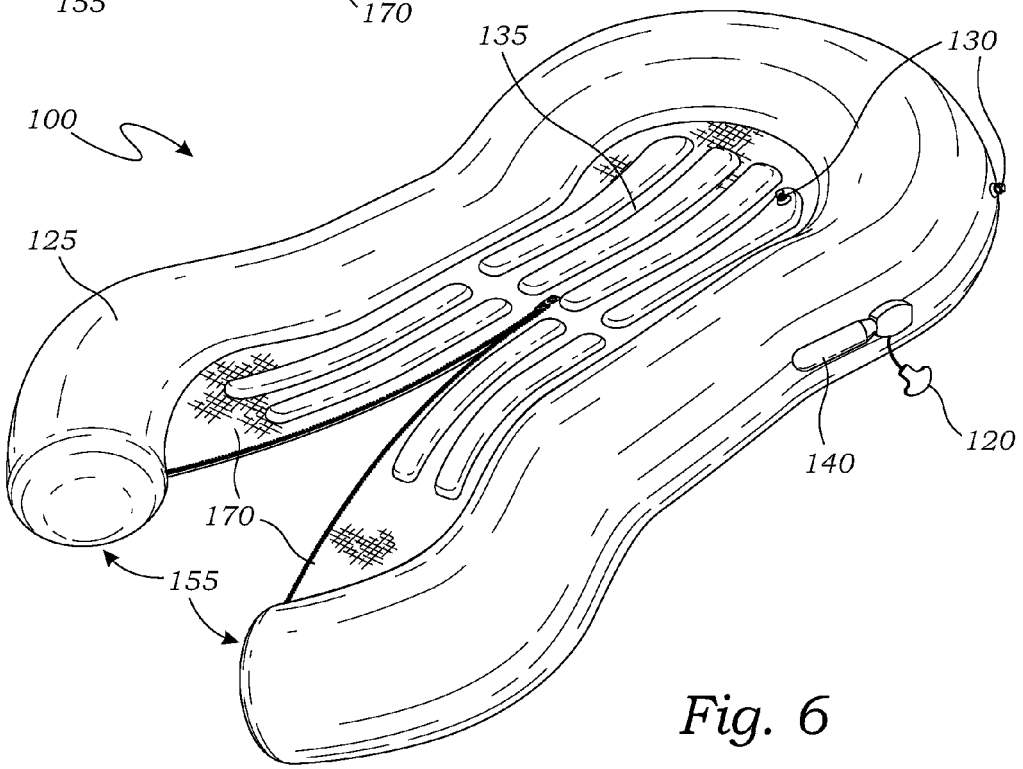
FIG. 6 is a perspective view of the same embodiment illustrated in FIG. 5 with the semi-detachable slit in the open orientation thereby allowing the terminal ends of the air bladder to be separated, forming an opening for easy boarding. Once the individual has boarded, the slit can be reclosed, thereby reorienting the terminal ends tightly adjacent to each other again.

FIGS. 5 and 6 illustrate a different embodiment of the apparatus featuring a semi-detachable floor slit 170 and split air bladder 125 with two terminal ends 155 that tightly abut each other, forming a continuous gunwale. When the semi-detachable floor slit 170 is in the open orientation, the terminal ends 155 can be separated forming a space for easy ingress. FIG. 6 illustrates the embodiment in the ingress orientation.

Figure 7:
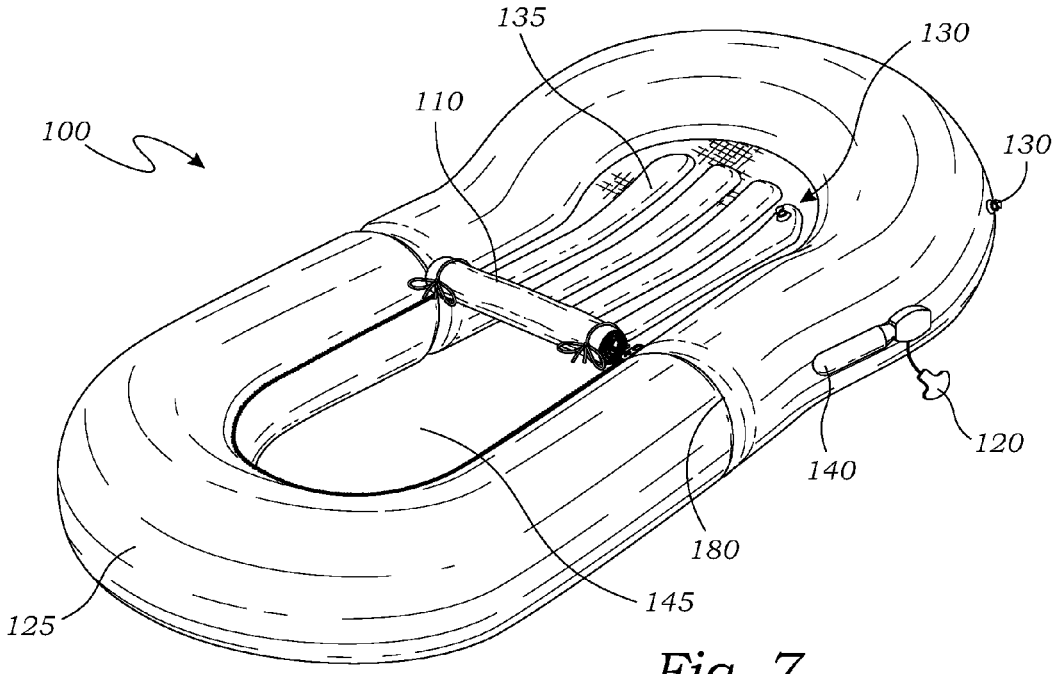
FIG. 7 and FIG. 8 are perspective views of the presently disclosed apparatus, featuring the semi-detachable flap in the open, rolled, and tethered orientation for easy boarding.
Figure 8:
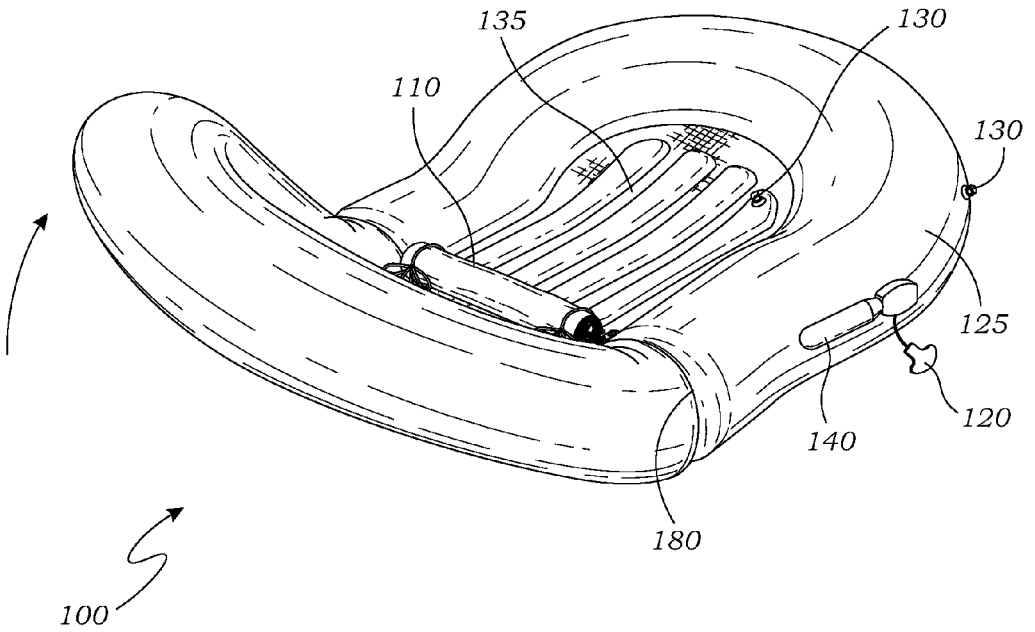

FIGS. 7 and 8 illustrate an additional air bladder segment 180 to increase flexibility and allow for an individual to more easily reach the ingress orifice 145. The air bladder segment 180 adds flexibility so that an individual can lift half of the apparatus 100 while the other half remains horizontal, supported by the water's surface as depicted in FIG. 8.

Figure 9:
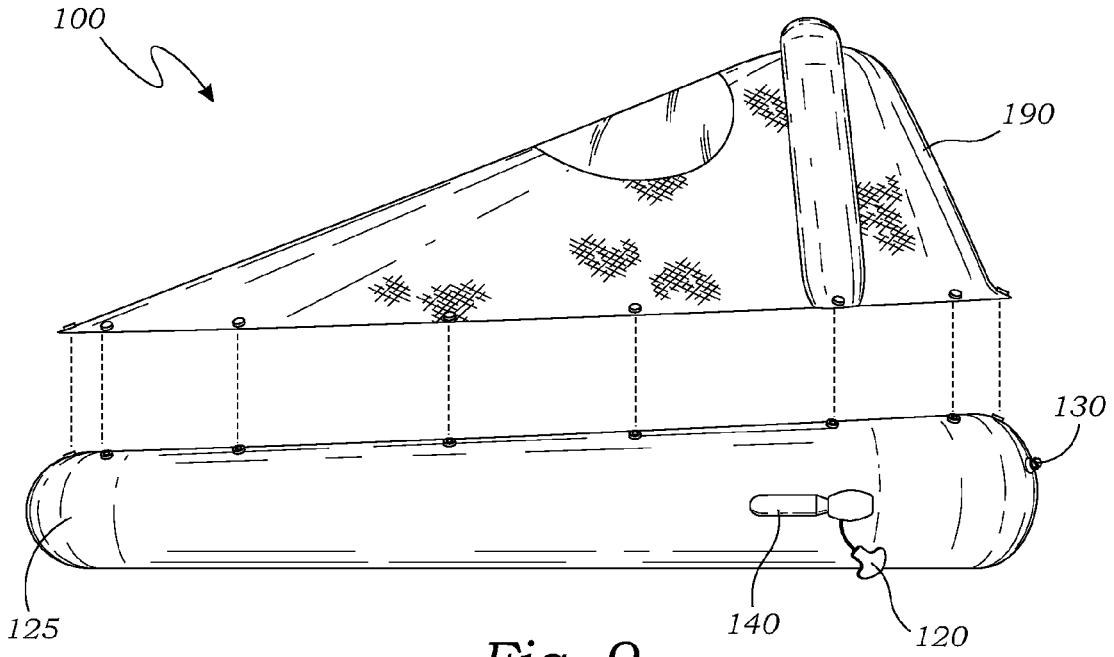
FIG. 9 is a side exploded view of an exemplary embodiment of the presently described apparatus illustrated fully deployed, featuring an optional protective canopy. The canopy in the illustration is affixed with snaps but other means of affixing the canopy are possible as well.
Figure 10:
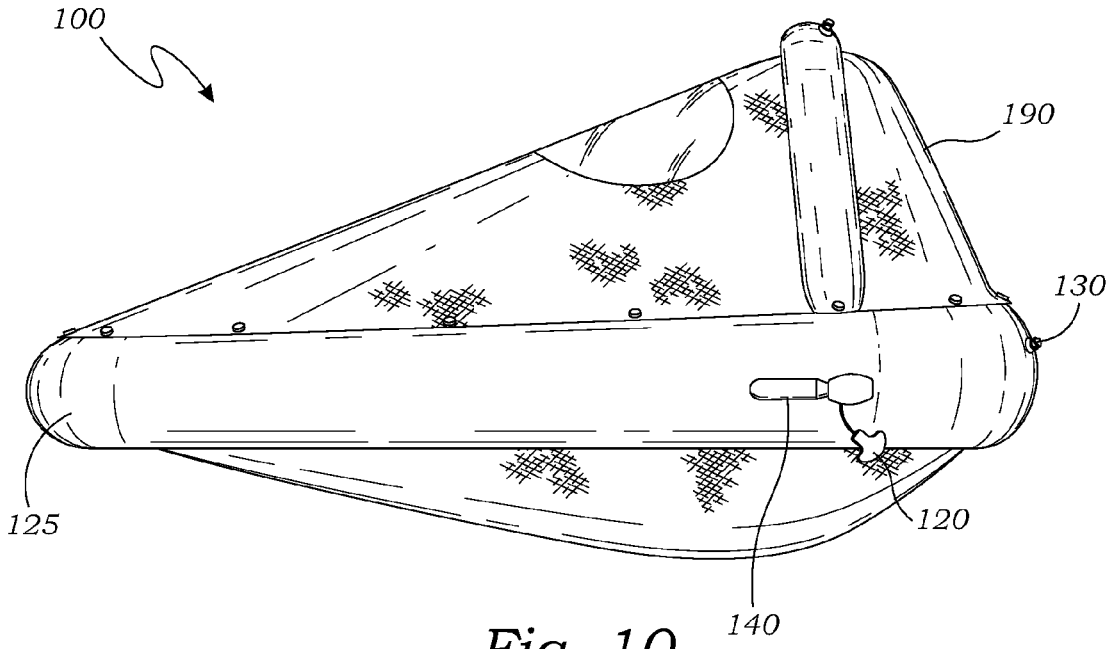
FIG. 10 is a side view of an exemplary embodiment of the presently described apparatus illustrated fully deployed, featuring a protective canopy and without an inflatable floor.

FIGS. 9 and 10 feature an optional canopy 190 to further protect an individual from the elements whether it be excessive sun, wind, or rain. The additional protection increases the thermal insulation of the individual and increases the chances of survival until assistance is able to arrive.

FIG. 11 features an exemplary embodiment of the present disclosure 100 featuring the semi-detachable flap 110 in a different location than the illustration in FIG. 1. This illustration is included to emphasize that the semi-detachable flap and ingress orifice can be oriented differently in different embodiments.

FIG. 12 features an illustration of an exemplar individual boarding the apparatus 100 through the ingress orifice 145.

The enablements described in detail above are considered novel over the prior art of record and are considered critical to the operation of at least one aspect of the apparatus and its method of use, and to the achievement of the above-described objectives. The words used in this specification to describe the instant embodiments are to be understood not only in the sense of their commonly defined meanings, but to include by special definition in this specification: structure, material, or acts beyond the scope of the commonly defined meanings. Thus, if an element can be understood in the context of this specification as including more than one meaning, then its use must be understood as being generic to all possible meanings supported by the specification and by the word(s) describing the element.

The definitions of the words or drawing elements described herein are meant to include not only the combination of elements which are literally set forth, but all equivalent structures, materials or acts for performing substantially the same function in substantially the same way to obtain substantially the same result. In this sense it is therefore contemplated that an equivalent substitution of two or more elements may be made for any one of the elements described and its various embodiments, or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, substitutions, now or later known to one with ordinary skill in the art, are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A flotation device, comprising:

a floor;

at least one perimetric flotation member, wherein a perimeter of said floor is attached to said perimetric flotation member; and whereby said apparatus is capable of transforming from a compact deflated state to an expanded inflated state;

at least one opening ingress orifice in said floor; and at least one flap;

wherein:

said flap is reversibly manipulatable between a closed orientation in which said flap covers said ingress orifice and an open orientation in which said flap does not cover said ingress orifice.

2. The flotation device of claim 1, wherein said flap is reversibly securable in a closed orientation to said floor using a zipper, a hook and loop system, snaps, buttons, or other fasteners.

3. The flotation device of claim 1, wherein at least the perimetric flotation member is constructed from a high-strength material having a thickness of no greater than 8 mils.

4. The flotation device of claim 1, wherein at least the perimetric flotation member is constructed from a high-strength material with a tensile strength of at least 23 lbs. per square inch.

5. The flotation device of claim 1, further comprising an automatic deployment mechanism configured to deploy at least the perimetric flotation member in an operable, buoyant state upon an activation of the automatic deployment mechanism.

6. The flotation device of claim 5, wherein said automatic deployment mechanism comprises a compressed gas cartridge.

7. The flotation device of claim 1, comprising an oral inflation mechanism configured to permit inflation of at least the perimetric flotation member.

8. The flotation device of claim 1, wherein said floor is inflatable.

9. A flotation device, comprising:

a support member forming a floor having a first surface and a perimeter;

an inflatable bladder member, said inflatable bladder member circumscribing at least a portion of the support member, a first portion of the support member being non-removably coupled with the inflatable bladder member; and an opening in the support member selectively coverable with a flap, at least one portion of the opening being adjacent to the inflatable bladder member;

wherein:

the flap is deflectable, rollable, or otherwise movable from a first position in which the opening is covered by the flap to a second position in which the flap does not cover all or a portion of the opening;

when the flap is in the second position, a user can enter the inflatable device through the opening in the support member;

the flap has a selectively reversible securing mechanism on a portion of the flap so that the flap is selectively securable in the first position;

the inflatable bladder member is capable of transforming from a compact deflated state to an expanded inflated state.

10. The flotation device of claim 9, wherein the opening is adjacent to the inflatable bladder member.

11. The flotation device of claim 9, wherein said flap is reversibly securable in the first position using a zipper, a hook and loop system, snaps, buttons, or other fasteners.

12. The flotation device of claim 9, wherein the bladder member is constructed from a high-strength material having a thickness of no greater than 20 mils and a tensile strength of at least 23 lbs. per square inch.

13. The flotation device of claim 9, further comprising an automatic inflation mechanism comprising a compressed gas cartridge configured to provide inflation to at least the bladder member upon an activation of the automatic inflation mechanism.

14. The flotation device of claim 9, further comprising an oral inflation mechanism configured to permit inflation of at least the bladder member.

15. The flotation device of claim 9, comprising a belt or a strap configured to secure the device to an individual.

16. The flotation device of claim 9, wherein the device is coupled with an individual's clothing or uniform.

17. A buoyant inflatable device, the device comprising:

a floor for supporting at least one user out of contact with a body of water;

an inflatable bladder coupled with the floor and forming a selectively closeable perimeter around the floor;

a first terminal end and a second terminal end formed in the air bladder; and a selectively detachable and reattachable interface in the floor that divides a portion of the floor into a first portion and a second portion and extends to the first and second terminal ends;

wherein:

the first portion of the floor is selectively detachable and reattachable with the second portion of the floor along the selectively detachable and reattachable interface to provide a selectively continuous support surface in the floor for a user of the device;

the first portion of the floor is movable or deflectable away from the second portion of the floor when the first portion is detached from the second portion of the floor; and the first portion of the floor is coupled with the first terminal end of the air bladder and the second portion of the floor is coupled with the second terminal end of the air bladder such that moving or deflecting the first portion of the floor away from the second portion of the floor simultaneously and automatically moves or deflects the first terminal end of the air bladder away from the second terminal end of the air bladder, thereby creating an ingress opening into the device between the first and second portions of the floor.

18. The flotation device of claim 17, wherein the first portion of the floor is selectively detachable and reattachable with the second portion of the floor along the selectively detachable and reattachable interface using a zipper, a hook and loop system, snaps, buttons, or other fasteners.

19. The flotation device of claim 17, further comprising an automatic inflation mechanism comprising a compressed gas cartridge configured to provide inflation to at least the bladder member upon an activation of the automatic inflation mechanism.

20. The flotation device of claim 17, further comprising an oral inflation mechanism configured to permit a user to manually inflate at least the inflatable bladder.

* * * * *